US006164996A

United States Patent [19]

Yu

[11] Patent Number: 6,164,996

[45] Date of Patent: Dec. 26, 2000

[54] PORTABLE CORNER-SITTING POWER STRIP

[76] Inventor: Jeff Yu, 2491 Ramke Pl., Santa Clara, Calif. 95050

[21] Appl. No.: 09/334,897

[22] Filed: Jun. 17, 1999

[51] Int. Cl.[7] ..... H01R 4/60

[52] U.S. Cl. ..... 439/216; 439/650; 439/954

[58] Field of Search ..... 439/650, 652, 439/215, 145, 654, 653, 954, 216; 174/67

[56] References Cited

U.S. PATENT DOCUMENTS

| | | | |
|---|---|---|---|
| 2,175,144 | 10/1939 | Davison | 439/216 |
| 2,175,145 | 10/1939 | Davison | 439/216 |
| 2,175,146 | 10/1939 | Davison | 439/216 |
| 2,175,147 | 10/1939 | Davison | 439/216 |
| 2,175,148 | 10/1939 | Davison | 439/216 |
| 2,190,196 | 1/1940 | Semenyna | 439/216 |
| 2,441,698 | 5/1948 | Gerspacher et al. | 439/216 |
| 4,975,070 | 12/1990 | Gillatt | 439/216 |
| 5,349,134 | 9/1994 | Russell | 174/48 |

*Primary Examiner*—Khiem Nguyen
*Assistant Examiner*—Hae Moon Hyeon
*Attorney, Agent, or Firm*—R J Services

[57] ABSTRACT

A corner-sitting power strip is provided for overcoming the disadvantages of the existing power strips. Briefly, the present invention is able to operate like a typical power strip and is further configured to sit snugly on a corner. While electrical plugs of appliances and equipment are coupled with the multiple receptacles of the power strip, a base face of the strip housing snugly pushes against one side of the corner, and another base face of the same housing snugly pushes against another side of the corner. At the same time, the dimensions of the housing is designed such that electrical cords of inserted plugs are channeled out from the power strip in a generally parallel fashion either projecting upward against one side of the corner or projecting downward against the other side of the corner. In this manner, in addition to the typical ability to lie flat on a surface as a typical power strip, the space savings, cord management and increased stability advantages of the present invention are also substantively realized.

6 Claims, 2 Drawing Sheets

PORTABLE CORNER-SITTING POWER STRIP

FIELD OF THE INVENTION

This invention relates to an electrical connector, such as a power strip having a plurality of receptacles for receiving electrical plugs of various appliances or equipment. More particularly, the present invention relates to a multiple receptacle power strip in which its housing is specially configured for stable positioning on a corner. A preferred embodiment of the present invention further relates to a power strip adapted to have its positioning further stabilized by the insertion of electrical plugs into its receptacles.

BACKGROUND INFORMATION

Power strips are primarily designed to enable multiple electrical appliances and equipment to draw power from a single source such as a wall outlet. The mechanism for the power strips is well known, and its presence is pervasive in the marketplace today. A typical power strip has an elongated housing with multiple receptacles uniformly disposed in a single row along a top surface of the strip. Each receptacle is configured to receive an electrical plug of an appliance or equipment. The inside of the power strip housing may further include a surge protection circuitry and/or other circuit breaking devices. In addition to the receptacles on the top surface, an ON/OFF power switch and LED indicators for power and surge protection may also be found.

Power strips of this type have disadvantages. A power strip typically lies flat on a floor or a table close to a wall outlet. It could be easily placed alongside to a wall corner when electrical plugs are not coupled with the strip receptacles. However, the power strip does not have much stabilizing force by itself. As the electrical plugs are inserted into the receptacles, the pulling and tucking forces of the electrical cords dictate as to where the power strip is ultimately positioned. Wherever that ultimate position is, it is no longer likely to be positioned snugly alongside the wall corner, and therefore more space is taken than otherwise necessary. In other words, space savings could be had if the power strip has sufficient stabilizing ability to withstand the forces of the electrical cords. Therefore, it would be desirable to have a power strip adapted to channel the pulling and tucking forces of the electrical cords not to decrease but to increase its stability.

Moreover, a typical power strip does not provide any cord management feature. The electrical cords of the inserted plugs tend to project upward from the strip and in time are likely to create multiple interlocking loops. Plug dislodgment and personal injuries are the likely results when people or objects trip over these loops. It would be therefore desirable to have a power strip providing a cord management feature to minimize the risks of plug dislodgment and personal injuries.

In view of the foregoing, it is desirable to provide a power strip that does not take up much space whether or not in use with electrical plugs. Further, it is desirable to have a power strip that provides a cord management feature and that at the same time channels the forces of the electrical cords of the inserted plugs to increase its stability.

Additional features and advantages of the invention will become apparent to those skilled in the art upon review of the following summary, drawings, the detailed description and the appended claims.

SUMMARY OF THE INVENTION

According to the foregoing and other features of our invention, a corner-sitting power strip is provided for overcoming the disadvantages of the existing power strips. Briefly, the present invention is able to operate like a typical power strip and is further configured to sit snugly on a corner. While electrical plugs of appliances and equipment are coupled with the multiple receptacles of the power strip, a base face of the strip housing snugly pushes against one side of the corner, and another base face of the same housing snugly pushes against another side of the corner. At the same time, the dimensions of the housing is designed such that electrical cords of inserted plugs are channeled out from the power strip in a generally parallel fashion either projecting upward against one side of the corner or projecting downward against the other side of the corner. In this manner, in addition to the typical ability to lie flat on a surface as a typical power strip, the space savings, cord management and increased stability advantages of the present invention are also substantively realized.

DETAILED DESCRIPTION OF THE PREFERRED EMBODIMENTS

With today's advances in technology, the power strip designs generally do not require the rendering of fully detailed implementation diagrams. The various implementations of electrical circuitry for power strips are well known to those skilled in the art. Accordingly, relevant aspects of the invention will be described in detail with the accompanying drawings. Those of ordinary skill in the art, once given the following descriptions of the various aspects of the invention will be able to implement the necessary mechanical and electrical arrangements in suitable technologies without undue experimentation.

Figure 1:
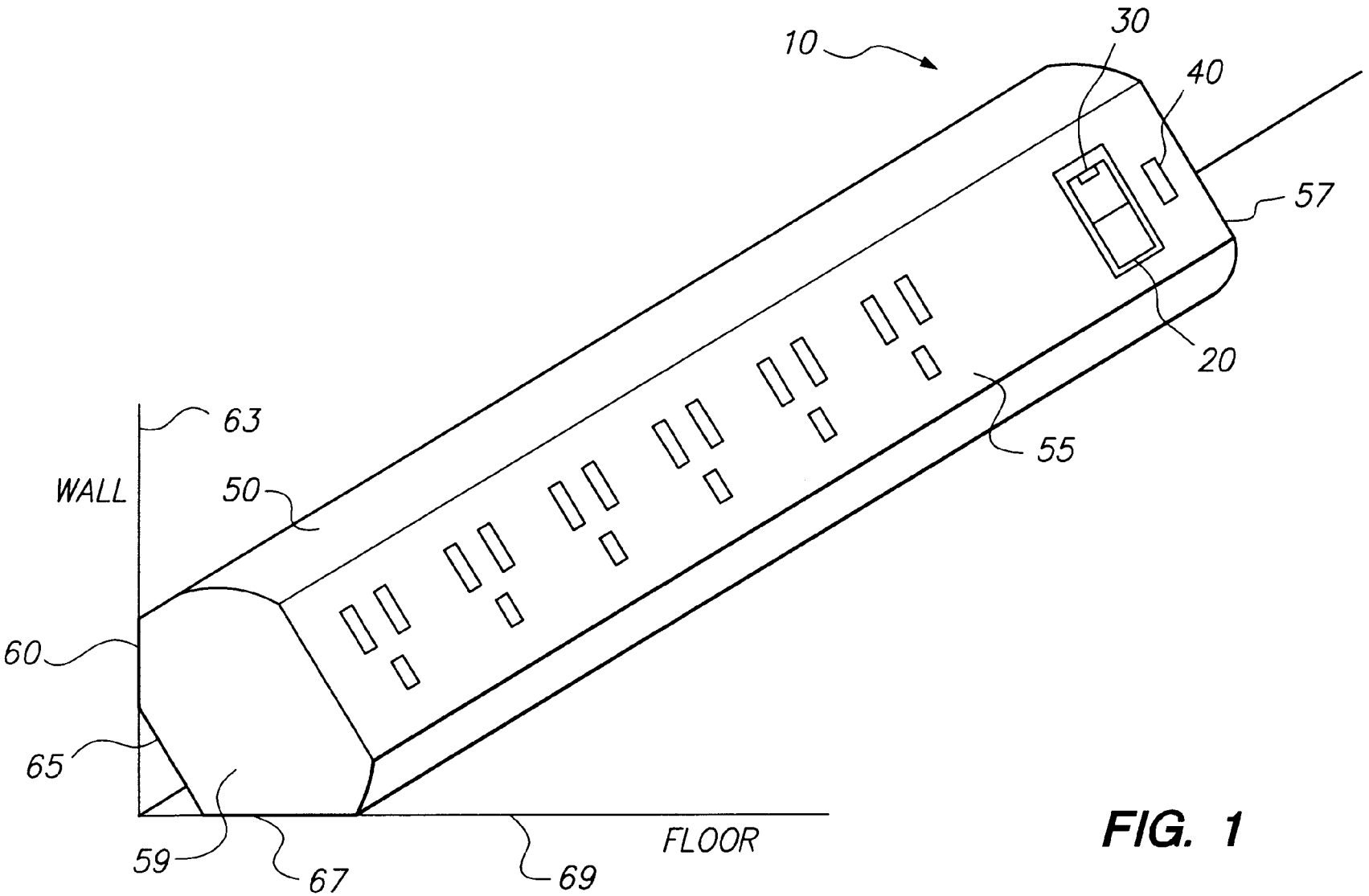
FIG. 1 is a perspective view of a preferred embodiment showing the appearance of the present invention.

Referring now to the drawings, FIG. 1 illustrates a perspective view of a corner-sitting power strip 10 in accordance with the present invention. The corner-sitting power strip 10 includes an elongated housing 50 that may be made of plastics or metal. This elongated housing has a top surface 55, two end surfaces 57,59 and three base surfaces 60,65,67. The base surface 60 of the power strip 10 pushes snugly against a wall 63 whereas the base surface 67 also pushes snugly against a floor 69. Further, the corner-sitting power strip 10 has multiple receptacles clearly in view located on the top surface 55. It also has an ON/OFF power switch 20 with an associated power indicator 30. In addition, a surge protection indicator 40 is also located next to the ON/OFF power switch 20 of the power strip 10. A power cord (not shown) of the power strip 10 that preferably feeds into the elongated housing 50 through one of the two end surfaces 57,59. The circuitry required for effecting the power strip and surge protection functions is not described here in detail because these functions are typical in the art and well known to the artisans. The width of the base surfaces 60,67 is preferably the same. It is further preferred that it be of sufficient width so that substantial portions of the base surfaces 60,67 are contiguous to the wall 63 and floor 69, respectively. The width of the base surface 65 is preferably sufficiently short and configured at an angle relative to the other two base surfaces 60,67 so that it allows the base surfaces 60,67 to snugly push against the wall 63 and the floor 69. At the same time, it is preferred that the width of the base surface 65 is sufficiently long so that the corner-sitting power strip 10 when in use with electrical plugs may also operatively lie flat on the floor 69 relying upon the base surface 65 alone.

Operatively speaking, the multiple receptacles on the top surface 55 of the corner-sitting power strip 10 are adapted to receive electrical plugs (not shown) of appliances. Since the corner-sitting power strip 10 is configured to sit on a corner, any pulling and tucking forces exerted by the appliance electrical cords and plugs would be channeled and directed to the wall 63 and the floor 69. In this manner and therefore unlike the typical power strips, the coupling of the corner-sitting power strip 10 in accordance with the present invention with multiple electrical cords and plugs actually increase the stability of the power strip 10 as it sits operatively on the corner. Furthermore, since the corner-sitting power strip 10 is firmly stabilized against the wall 63 and the floor 69, the electrical cords of the coupled plugs then tend to project either upward or downward in a generally parallel fashion whereby providing an inherent advantage of cord management. Because of the corner sitting aspect of the present invention, the power strip 10 provides the space savings advantage it would not have otherwise had. As an aside, the corner in FIG. 1 is made between the wall 63 and the floor 69. In practice, any corners would do, for example, corners made between walls and edges of tables or equipment are also applicable.

Figure 2:
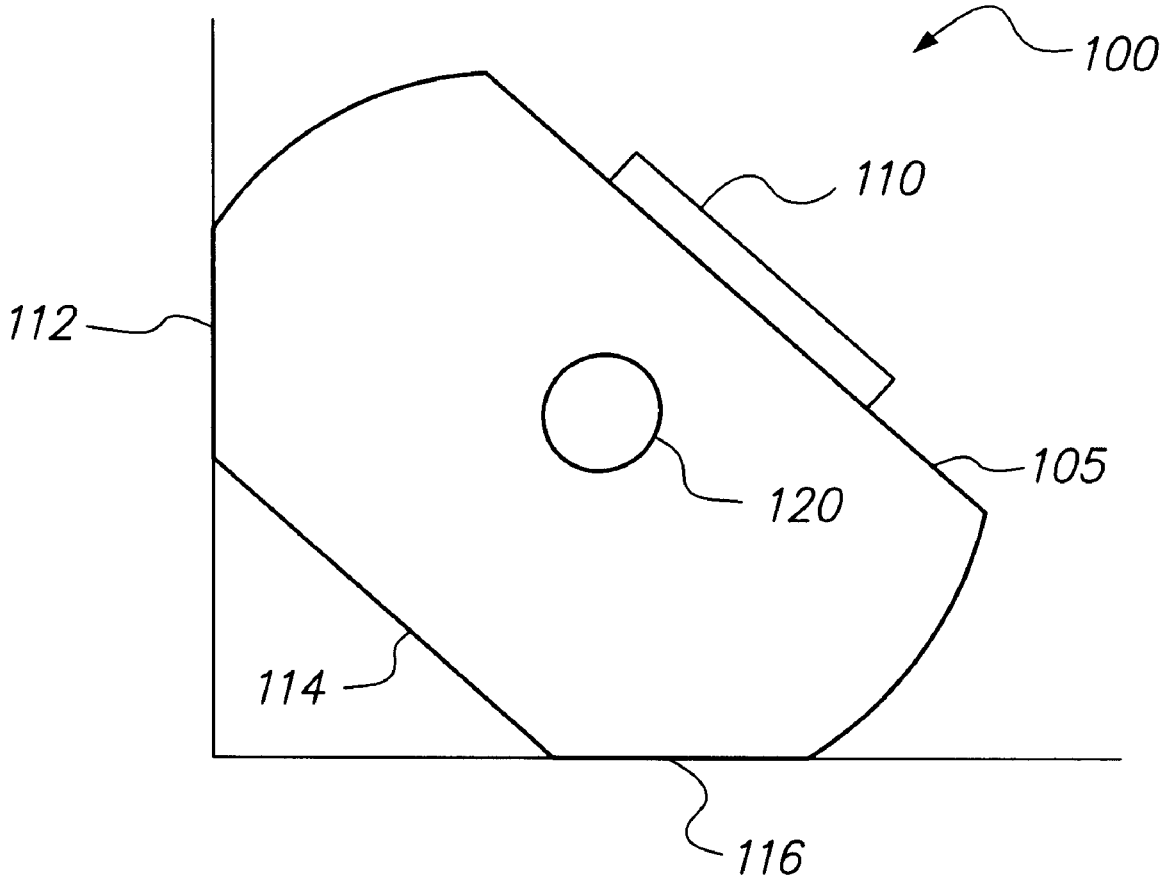
FIG. 2 is a side view illustrating how another preferred embodiment of the present invention sits on a corner.

FIG. 2 shows a side view of a corner-sitting power strip 100 having housing 105. This housing 105 further includes multiple receptacles 110 and a power cord entrance 120 feeding into the corner-sitting power strip 100. The housing 105 also has three base surfaces 112, 114,116. Overall, FIG. 2 illustrates how the corner-sitting power strip 100 sitting snugly on a corner relying on two of its base surfaces 112,116. Preferably, the base surfaces 112 and 116 each has a width of 15 to 20 mm. For the base surface 114, the preferred width ranges between 25–35 mm; and more specifically, a particular width preference is 30 mm. The angles made between the base surface 114 and each of the other two base surfaces 112, 116 is preferably at 135 degrees. In sum, in addition to its corner-sitting feature, it is clear from FIG. 2 that if need be, the corner-sitting power strip 100 can operate like typical power strips by lying flat on a floor or a table. Therefore, in this way, advantageously speaking, the space savings, cord management and increased stability advantages of the present invention are all inexpensively and simply realized.

While the present invention has been described in terms of a couple of preferred embodiments, it is contemplated that persons reading the foregoing detailed description and studying the drawing will realize various alterations and modifications for this invention. It is therefore intended that the following appended claims be interpreted as including all such alterations and modifications as fall within the true spirit and scope of the present invention.

I claim:

1. A portable power strip having an elongated housing and multiple receptacles located on a top surface of the elongated housing, said power strip comprising:

circuitry means for enabling multiple electrical appliances and equipment to draw electrical power from a single power source including a wall outlet by inserting electrical plugs of the multiple electrical appliances into the multiple receptacles;

said elongated housing configured to contain said circuitry means and further including three base surfaces adapted to be stabilized sitting on a corner wherein the middle base surface having a sufficient width and making an appropriate angle with each of the other two side base surfaces such that while said electrical plugs being coupled with the multiple receptacles the other two side base surfaces being snugly stabilized against the sides of the corner, said housing not being fastened to the corner for ease of transport; and said two side base surfaces of said elongated housing each having sufficient width such that a substantial portion of each side base surface being contiguous to a side of the corner, and such that the pulling and tucking forces of the electrical plugs being channeled and directed to the sides of the corner.

2. The power strip as claimed in claim 1 wherein the width of the middle base surface ranges from 25 mm to 35 mm.

3. The power strip as claimed in claim 2 wherein the width of the middle base surface is 30 mm.

4. The power strip as claimed in claim 1 wherein the width of each of the two side base surfaces ranges from 15 mm to 20 mm.

5. The power strip as claimed in claim 1 wherein the angle made between the middle base surface and each of the two side base surfaces is 135 degrees.

6. A portable power strip having an elongated housing and multiple receptacles located on a top surface of the elongated housing, said power strip comprising:

circuitry means for enabling multiple electrical appliances and equipment to draw electrical power from a single power source including a wall outlet by inserting electrical plugs of the multiple electrical appliances into the multiple receptacles;

said elongated housing configured to contain said circuitry means and further including three base surfaces adapted to be stabilized sitting on a corner wherein the middle base surface having a width of 30 mm and making an angle of 135 degrees with each of the other two side base surfaces such that while said electrical plugs being coupled with the multiple receptacles the other two side base surfaces being snugly stabilized against the sides of the corner, said housing not being fastened to the corner for ease of transport; and said two side base surfaces of said elongated housing each having sufficient width ranging from 15 mm to 20 mm such that a substantial portion of each side base surface being contiguous to a side of the corner, and such that the pulling and tucking forces of the electrical plugs being channeled and directed to the sides of the corner.

* * * * *